US006123777A

United States Patent [19]

Sakurai et al.

[11] Patent Number: 6,123,777

[45] **Date of Patent: *Sep. 26, 2000**

[54] METHOD FOR CLEANING STRUCTURAL SURFACE

[75] Inventors: Nobuo Sakurai; Hanako Nagai; Boon Keng Lim, all of Chohu; Gun-ichi Kobayashi, Tokyo, all of Japan

[73] Assignee: Kajima Corporation, Tokyo, Japan

[ * ] Notice: This patent is subject to a terminal disclaimer.

[21] Appl. No.: 09/038,978

[22] Filed: Mar. 12, 1998

[30] Foreign Application Priority Data

| | | | |
|---|---|---|---|
| Mar. 14, 1997 | [JP] | Japan | 9-061290 |
| Aug. 1, 1997 | [EP] | European Pat. Off. | 97305836 |
| Mar. 4, 1998 | [JP] | Japan | 10-052553 |

[51] Int. Cl.[7] ..... B08B 7/04

[52] U.S. Cl. ..... 134/4; 134/6; 134/26

[58] Field of Search ..... 134/4, 6, 26

[56] References Cited

U.S. PATENT DOCUMENTS

| | | | |
|---|---|---|---|
| 3,950,185 | 4/1976 | Toyama et al. | 134/38 |
| 5,188,675 | 2/1993 | Dormon-Brailsford | 134/4 |
| 5,779,811 | 7/1998 | Machii et al. | 134/4 |

*Primary Examiner*—Zeinab El-Arini

*Attorney, Agent, or Firm*—Oblon, Spivak, McClelland, Maier & Neustadt, P.C.

[57] ABSTRACT

A method for cleaning structural surface 1 by forming a substratum membrane 17*a* thereon through application and drying of a thin layer 16 of aqueous solution 5 of membrane-forming polymer 2 on a structural surface, spreading a fibrous reinforcing member 15 on the thin layer 16 before drying or the substratum membrane 17*a* after dried, and applying the aqueous solution 5 on the outer surface of the reinforcing member 15 while wetting it in such a manner that, upon drying, an overlying membrane 17*b* integral with both the substratum membrane 17*a* and the reinforcing member 15 is formed so as to generate a multi-layer membrane 18 having the substratum and overlying membranes sandwiching the reinforcing member. After causing foreign matters on the structural surface 1 to adhere onto the substratum membrane 17*a,* the multi-layer membrane 18 is peeled off from the structural surface 1.

22 Claims, 7 Drawing Sheets

METHOD FOR CLEANING STRUCTURAL SURFACE

TECHNICAL FIELD

This invention relates to a method for cleaning structural surface. In particular, the invention relates to a structural surface cleaning method including steps of forming a peelable membrane on a structural surface by applying an aqueous solution or aqueous emulsion (hereinafter, the words "aqueous solution" will be used to mean an "aqueous solution or aqueous emulsion", unless any ambiguity is brought about) of a membrane-forming polymer thereon, and causing dirt substance on the structural surface to be adhered to the membrane, and peeling off the membrane from the structural surface together with the dirt substance adhering thereto.

BACKGROUND ART

Conventional methods for removing dirt from structural surface include washing with water, washing with chemical, sand-blasting, and the like. Such conventional methods have a problem in that they tend to scatter water or dirt substance to the surrounding, and it is usually difficult to prevent such scattering completely. Due to the increased public concern on environment, unless such problem is solved, chance of using the conventional methods will be gradually diminished.

To solve the above problems of the conventional methods, the inventors disclosed an invention titled "Cleaning Method Of Indoor and Outdoor Structural Surface" in his Japanese Patent Application No. 321032/1995 filed on Nov. 15, 1995. This cleaning method will be briefly reviewed by referring to FIGS. 5A–5E and 6 showing a case of cleaning the surface 10 of a building structure. In this example, cleaning zones 10*a,* 10*b,* 10*c,* . . . of an overall surface 10 of a building are successively cleaned one after another (see steps 601 and 602 of FIG. 6).

At first, it is confirmed that a structural wall is divided into a number of cleaning zones and that one of such zones, e.g., the cleaning zone 10*a* is to be cleaned to begin with, and a polymer solution 5*a,* which is made by dissolving adhering-membrane-forming-polymer 2*a* in a solvent 9, is applied to the zone 10*a* twice in the step 603. Each step of application produces a thin membrane 6*a* on the cleaning zone 10*a,* as shown in FIG. 5A. Arrows a and b indicate that, after a thin membrane 6*a* formed by a first application of the polymer 2*a* as shown by the arrow a is dried by evaporation of the solvent 9 to become an adhering membrane, a second application as shown by the arrow b is made so as to produce another thin membrane 6*a* applied thereon. With the use of two thin membranes 6*a,* a laminated adhering membrane 7*a* is formed on the cleaning zone 10*a* in a peelable manner, as shown in FIG. 5B. Dirt substance on the cleaning zone 10*a* are caused to adhere to the laminated adhering membrane 7*a* for cleaning the zone 10*a* at the step 604.

FIG. 5B through FIG. 5E show that by repetition of the steps 602–604, the remaining cleaning zones 10*b,* 10*c,* . . . of the surface 10 are also covered by the laminated adhering membranes 7*a* and cleaned (see steps 605 and 606 of FIG. 6). FIG. 5E indicates that, in this example, after the entire building structure is finished the laminated adhering membranes 7*a* on all the cleaning zones 10*a,* 10*b,* 10*c,* . . . of the structural surface 10 are removed simultaneously in one stroke (see step 607 of FIG. 6.)

With the cleaning method for the surface 10 of a structure, as shown in FIGS. 5A–5E and 6, a laminated adhering membrane 7*a* can be formed on a wide surface or intricately shaped surface of a structure in a short period of time simply by applying a polymer solution 5*a* thereon twice through brushing or spraying. The method not only facilitates removal of dirt substances, but also provides protection of structural surface and prevention from dirt deposit, and one can expect saving in labor for such cleaning, protection, and prevention of deposit by using the method. Examples of the adhering-membrane-forming-polymer 2*a* include polyvinyl alcohol, carboxymethyl cellulose, polyvinyl chloride, acrylic resin, and polyvinyl butyral. The solvent 9 can be water or an organic solvent.

Thus, the method of cleaning structural surface by using the above laminated adhering membrane 7*a* has certain advantages; e.g., in the ease of operation for applying the polymer solution, in the readiness of handling the polymer solution, in facilitation of peeling operation of the polymer membrane by using the laminated structure of the membrane, and in simplification of the disposal of the used membranes. If water is used as the solvent 9 of the polymer solution 5*a,* there is no risk of generating poisonous gas or stench gas when applying it on surfaces to be cleaned, and the solution is free from catching fire.

Membranes formed by spreading of aqueous solution of water-soluble polymer, however, tend to be weakened and lose flexibility when water contained therein evaporates to dry them, despite that as long as moisture above a certain level is kept the flexibility and toughness of the membranes are maintained. Weakened membranes are easily torn when peeling force is applied thereto, and the process of peeling the membrane becomes cumbersome and time-consuming. Especially, in the case of a rough structural surface with projections and recesses, when the aqueous polymer solution is applied thereon and a membrane is formed by drying of it, the membrane tends to become comparatively thin at portions corresponding to the projections of the rough surface and comparatively thick at portions corresponding to the recesses thereof. Due to the thickness difference at different portions of the membrane, unevenness of strength is produced therein; i.e., there are weak portions and strong portions in the membrane. When peeled from structural surface, the membrane tears at weak portions and tearing cracks spread, so that pealing of the membrane as one piece becomes difficult. Even with the above-mentioned "Cleaning Method Of Indoor and Outdoor Structural Surface", it was difficult to prevent the tearing of the laminated adhering membrane due to the roughness of the structural surface. When torn, broken pieces of the membrane tend to be scattered around the structure, and laborious process of collecting the scattered pieces and cleaning the surrounding becomes indispensable. Thus, there has been a need for solving the problem related to the weakness of the membrane of water-soluble polymer.

Therefore, it is an object of the invention to provide a method for cleaning structural surface by using easily peelable and readily recoverable membrane of water-soluble polymer.

DISCLOSURE OF INVENTION

To fulfill the above object, the inventors noted the following facts. Firstly, the strength and toughness of a polymer membrane, which is applied on a structural surface for cleaning purposes, can be improved by providing a gauze or similar fibrous reinforcing member so as to make it an integral portion of the polymer membrane, or by mixing short fibers in the membrane. Secondly, the inventors have found that the toughness of the dried membrane of water-soluble polymer depends on the remaining moisture therein, which remaining moisture is affected by the thickness of the membrane when applied on surface to be cleaned.

Based on the knowledge of such facts, the inventors have succeeded in completing the invention through a number of experiments and analyses.

Referring to FIGS. 1 and 2A–2F, an embodiment of the method of the invention for cleaning a structural surface 1 by forming a peelable polymer membrane 18 thereon is characterized in that a thin layer 16 of an aqueous solution 5 or emulsion of such membrane-forming polymer 2 is applied on a structural surface 1, which polymer 2 produces a substratum membrane 17*a* upon drying of the thin layer 16, a fibrous reinforcing member 15 is spread on either the thin layer 16 before drying or the substratum membrane 17*a* after dried, and the aqueous solution 5 or emulsion is applied on the outer surface of the reinforcing member 15 while wetting the reinforcing member 15 in such a manner that, upon drying, an overlying membrane 17*b* integral with both the substratum membrane 17*a* and the reinforcing member 15 is formed so as to generate a multi-layer membrane 18 having the substratum and overlying membranes 17*a,* 17*b* sandwiching the reinforcing member 15, whereby after adhesion of foreign matters 8 on the structural surface 1 to the substratum membrane 17*a,* the multi-layer membrane 18 is peeled off from the structural surface.

BRIEF DESCRIPTION OF DRAWINGS

For a better understanding of the invention, reference is made to the accompanying drawings, in which.

Like parts are designated by like numerals and symbols throughout different views of the drawing.

DESCRIPTION OF PREFERRED EMBODIMENTS OF THE INVENTION

Figure 1:
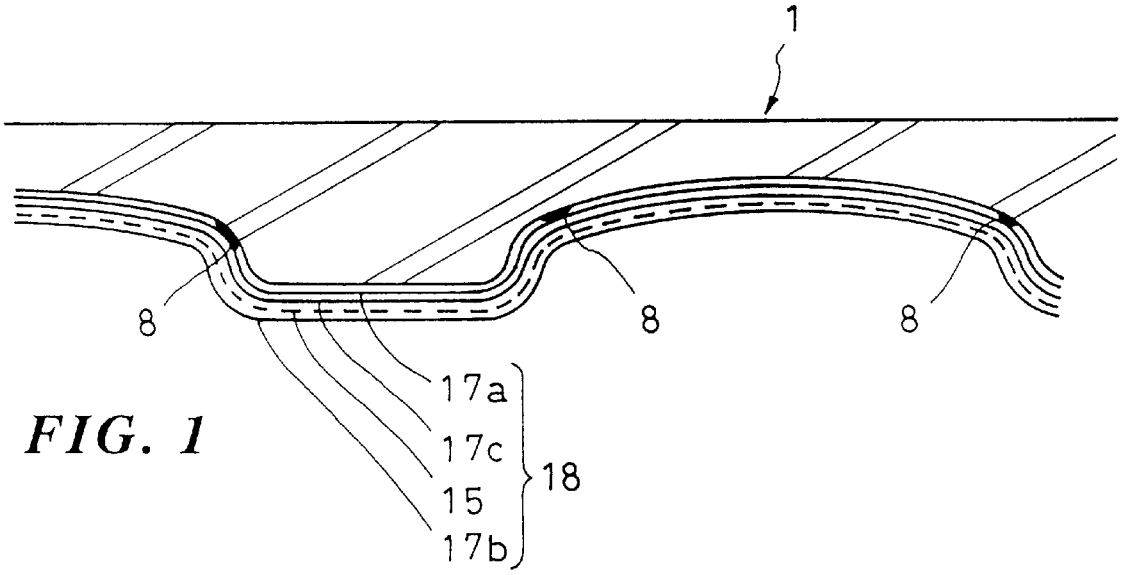
FIG. 1 is a partial sectional view of a structural surface 1 which is being cleaned by a method of the invention.

In a preferred embodiment of the invention, after the substratum membrane 17*a* is formed, another thin layer 16 of the aqueous solution 5 of polymer 2 is applied on the substratum membrane 17*a* (see FIG. 3C) for inserting an intermediate membrane 17*c* (FIG. 1), and a fibrous reinforcing member 15 is spread on the thin layer 16 before it dries. The above-mentioned overlying membrane 17*b* is formed on the fibrous reinforcing member 15 so as to be integral therewith. Thereby, a quadruple multi-layer membrane 18 having the substratum membrane 17*a,* the intermediate membrane 17*c,* the fibrous reinforcing member 15, and the overlying membrane 17*b* is formed on the structural surface 1. Due to the viscousness of the polymer 2 in the substratum membrane 17*a,* foreign matters 8 such as dirt substances on the structural surface 1 tend to adhere to the substratum membrane 17*a,* and after such adhesion of the foreign matters 8, the multi-layer membrane 18 is peeled off from the structural surface 1 together the foreign matter 8 carried thereby. Thus, the structural surface 1 is cleaned, as desired.

An example of the fibrous reinforcing member 15 is those of woven fabric, paper, and the like which can be wetted by the above-mentioned aqueous solution 5. Preferably, the fibrous reinforcing member 15 is such a sheet member to which the aqueous solution 5 of membrane-forming polymer 2 permeates. With such permeable fibrous reinforcing member 15, the aqueous solution 5 may be permeated from the top surface of the reinforcing member 15 to the substratum membrane 17*a* below the member 15, so that the overlying membrane 17*b* can be made integral with both the substratum membrane 17*a* and the fibrous reinforcing member 15. Such member 15 may be made of fibers having a high affinity with water, or fibers with a lower affinity with water but with large inter-fiber gaps, such as gaps of a net, so as to ensure integral bondage of the membrane-forming polymer 2 with the fibrous reinforcing member 15. Examples of such sheet material are gauze, non-woven fabric, plastic net, glass fiber mat, and the like.

In addition to the fibrous reinforcing member 15, or in lieu of the fibrous reinforcing member 15, wood pulp such as that made of short fibers of 3 to 10 mm can be mixed in the polymer membrane of the multi-layer membrane 18. In this case, the short fibers may be added in the aqueous solution 5 of the membrane-forming polymer 2 so as to be dispersed therein, and the mixed solution thus prepared may be used to form a fibrous reinforcing member in the multi-layer membrane 18. Such mixed solution may be spread by a brush, a roller, a spray, a rubber spatula, a medicine spoon, a sweeping board such as a rubber blade, or a roller connected to a solution supply hose. According to test results, when the structural surface 1 has many recesses and projections, the use of a fibrous reinforcing member of mixed solution with short fiber will facilitate application of the fiber-mixed aqueous solution 5 to every corner of recesses between projections, whereby cleaning effect is enhanced and at the same time the peeling and recovery of the multi-layer membrane 18 are made easier. Examples of such short fibers are wood pulp, cotton, acrylic resin, polyester, silk, hemp yarn, plastics, glass fibers, and the like. Two or more of such short fibers may be used as a mixture. The length of the short fiber may 3–10 mm. If it is shorter than 3 mm, one cannot expect a sufficient improvement of membrane strength and toughness, and if longer than 10 mm, the fibers tend to be entangled and become hard to be dispersed.

The number of each of the substratum membrane 17*a,* intermediate membrane 17*c,* and overlying membrane 17*b* in the multi-layer membrane 18 is not restricted to one, and the number of each constituent membrane may be adjusted depending on the conditions of the structural surface to be cleaned. The fibrous reinforcing member 15 is used to reinforce the polymer membrane, so that the thickness and the quantity of the fibrous reinforcing member 15 to be used will be properly determined depending on the physical properties of the polymer 2, the thickness of the multi-layer membrane 18, method of peeling, the location of cleaning operation, strength of the single fiber, the strength of fibrous layer, the affinity of the fiber and the polymer, and the like.

The membrane-forming polymer 2 to be used in the method of the invention is water soluble. The polymer 2 dissolved in water 4 can be applied on the structural surface 1 in the form of a thin layer 16. After the evaporation of water 4, the thin layer 16 produces a substratum membrane 17*a* or overlying membrane 17*b* (the substratum and overlying membranes may be jointly referred to as membrane 17, hereinafter) depending on the position in the multi-layer membrane 18. Examples of such membrane-forming polymer 2 are one or more materials selected from the group consisting of polyvinyl alcohol (may be referred to as PVA, hereinafter), ethylene/vinyl acetate copolymer, vinyl acetate, carboxymethyl cellulose, polyvinyl acetate, acrylic resin, polyvinyl butyral, and the like. Preferable polymers are PVA and/or thylene/vinyl acetate copolymer.

For instance, PVA having a degree of polymerization of 500–5,000, preferably 1,000–3,000, and a degree of saponification of 90–99 mole % can be used. The concentration of ethylene/vinyl acetate copolymer in the aqueous solution 5 can be selected depending on the material of the structural surface 1, surrounding conditions, and a method of spreading, and its preferable range is 40–80 weight % (Wt. %), preferably 50–70 Wt. %. The contents of vinyl acetate in the ethylene/vinyl acetate copolymer may be 98–50 mole %, preferably 80–60 mole %. To adjust the physical properties of the polymer 2, a copolymer with multiple monomers including acrylic acid, methacrylic acid, acrylic ester, methacrylic ester, vinyl chloride, and the like may be used.

The concentration of the membrane-forming polymer 2 in the aqueous solution 5 is selectable in a range suitable for producing the membrane 17, depending on the material of the structural surface 1, the environmental conditions at the site of cleaning, and the method of applying the solution 5. The following Table 1 shows the results of tests on five specimens of aqueous solution 5 of PVA as the membrane-forming polymer 2 at different concentrations. Each specimen of the solution 5 was spread on a concrete surface to form a membrane 17.

TABLE 1

| No. | Aqueous solution of polymer* | Membrane produced |
|---|---|---|
| 1 | PVA 3% | No peelable membrane |
| 2 | PVA 5% | Thickness: 0.05 mm |
| 3 | PVA 15% | Thickness: 0.10 mm |
| 4 | PVA 30% | Thickness: 0.20 mm |
| 5 | PVA 70%** | Thickness uneven |
| 6 | EVA*** 56% | Thickness: 0.10 mm |

*Wt. % of membrane-forming polymer based on the entire weights of aqueous solution
**Solution inhomogeneous, causing membrane thickness uneven
*Ethylene/vinyl acetate copolymer Referring to lines 1 and 5 of Table 1, 3 Wt. % aqueous solution 5 did not produce a peelable membrane 17, while a 70 Wt. % aqueous solution 5 caused difficulty in spreading an evenly thin layer 16 and did not produce a membrane 17 of even thickness. On the other hand, lines 2 to 4 of Table 1 show that 5–30 Wt % aqueous solutions 5 can produce peelable membranes of different thickness. The thickness of the membrane 17 depends on the viscosity of the aqueous solution 5, and if the PVA concentration is low, the viscosity of the aqueous solution 5 is small, and the membrane 17 becomes thin. To the contrary, if the PVA concentration is high, the viscosity of the aqueous solution 5 becomes large, and the membrane 7 gets comparatively thick. One can choose a suitable viscosity of the aqueous solution, considering the method for spreading or applying it on the structural surface 1. Based on the test results of Table 1, the concentration of PVA as the membrane-forming polymer in the aqueous solution 5** can be selected in the range of 5 to 30 Wt. %.

Sixth line of Table 1 shows that application of an aqueous emulsion 5 of ethylene/vinyl acetate copolymer on a concrete surface produced a membrane 17 of 0.10 mm thick. In the test of Table 1, an aqueous emulsion with 56 Wt. % of ethylene/vinyl acetate copolymer, produced by Kabushiki-kaisha KURARE with Tradename Panflex OM-28, was used.

Figure 2A:
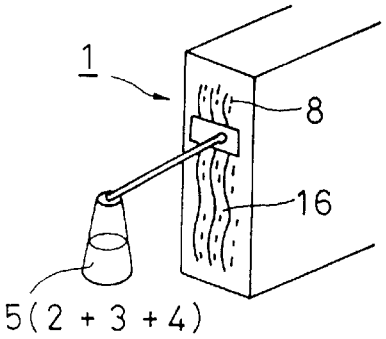
FIGS. 2A–2F show various steps for producing a multi-layer membrane to be used in the cleaning method of the invention.
Figure 2B:
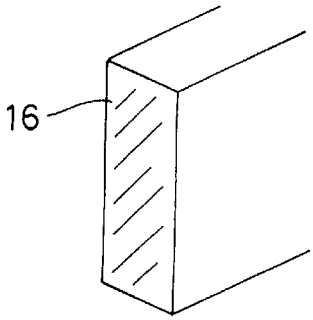
Figure 2C:
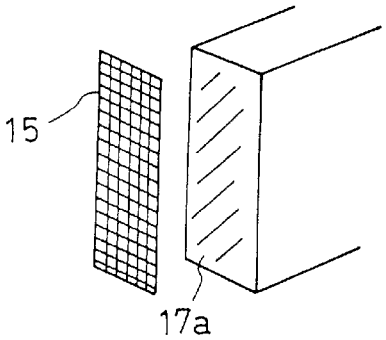

Referring to FIG. 2A, the aqueous solution 5 can be applied on the structural surface 1 by using a brush, a roller, a spray, or an injector. FIG. 2B shows a painted zone of a structural surface 1, on which zone the aqueous solution 5 is applied as a thin layer 16. Water in the thin layer 16 evaporates in a few hours in the case of natural drying, or in 5–10 minutes when dried by blowing air of 40–60° C., so as to become a substratum membrane 17*a* sticking to the structural surface 1 as shown in FIG. 2C. Due to the viscosity of this substratum membrane 17*a,* foreign matters 8 such as dirt substance on the structural surface 1 can be adhered to the substratum membrane 17*a* so as to be removed together with the latter being peeled off. It is also possible to protect the structural surface 1 against subsequent deposit of dirt or damage from outside by the substratum membrane 17*a.* Attention should be paid to the fact that the substratum membrane 17*a* is flexible and easily peelable when it keeps a certain moisture, but when dried excessively, it may lose toughness and weakened, and the peeling and recovery of it after cleaning operation may become cumbersome.

Figure 2D:
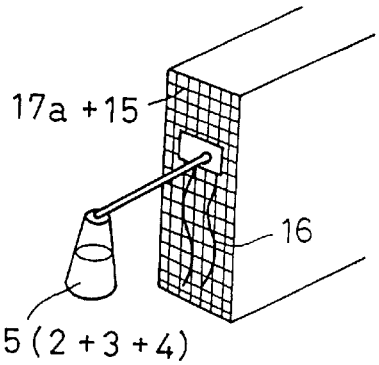
Figure 2E:
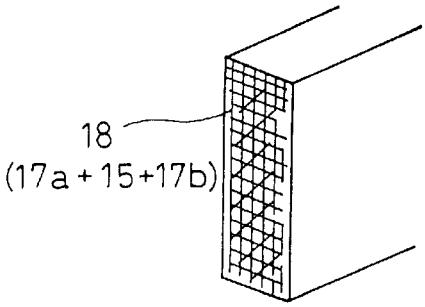

In the embodiment of FIGS. 2A–2E, a fibrous reinforcing member 15 (FIG. 2C) is spread on the substratum membrane 17*a* which is formed on the structural surface 1. Then, an overlying membrane 17*b* is formed as shown in FIG. 2D, by applying another thin layer 16 of the aqueous solution 5 thereon while wetting both outer and inner surfaces thereof. The fibrous reinforcing member 15 can be made integral with the thin layer of the polymer 2, so that the membrane 17 is tightly bonded to the fibrous reinforcing member 15, which bondage contributes to the strength of the membrane 17 against tearing. More specifically, inner surface of the fibrous reinforcing member 15 is tightly bonded to the substratum membrane 17*a,* while the outer surface of the fibrous reinforcing member 15 is integrally joined to the overlying membrane 17*b,* so that an integral combination of the substratum membrane 17*a,* the fibrous reinforcing member 15, and the overlying membrane 17*b* formulates a multi-layer membrane 18 (see FIG. 2E).

If the steps of FIGS. 2C through 2D are repeated, a multi-layer membrane 18 with a plurality of the fibrous reinforcing members 15 and overlying membranes 17*b* can be formed.

Figure 2F:
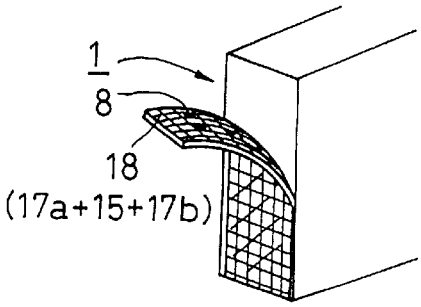

As shown in FIG. 2F, the multi-layer membrane 18 can be peeled off from the structural surface 1 while maintaining its multi-layer configuration intact. In contrast to the conventional laminated adhering membrane 7*a* of FIG. 5 which is susceptible to weakening and fracturing into pieces at the time of peeling, the multi-layer membrane 18 of the invention causes peeling of the membrane 17 as an integral combination with the fibrous reinforcing member 15 without breakage, so that the operation of peeling and recovering of the membrane 17 for cleaning the structural surface 1 is greatly simplified.

The use of the multi-layer membrane 18 has effects of simultaneously simplifying both the application of the aqueous solution 5 and the peeling of the membranes 17. In particular, from the standpoint of easy application, low viscosity of the aqueous solution 5 is desirable, and aqueous solution 5 with a low viscosity tends to make the membrane 17 thin. On the other hand, from the standpoint of easy peeling and recovery of the membrane 17, strength or thickness of the membrane 17 in excess of a certain value is required. With the present invention, multiple application of easily applicable aqueous solution 5 results in a sufficiently thick multi-layer membrane 18 for facilitating easy peeling and recovery.

Thereby, the above-mentioned object of the invention which is to provide a method for cleaning structural surface by using easily peelable and readily recoverable membrane of water-soluble polymer is fulfilled.

After being peeled off, the multi-layer membrane 18 may be recycled by dissolving the polymer 2 in warm water and separating foreign matters 8 and fibrous reinforcing member 15 therefrom. Hence, it does not cause any contamination of the environment. Tools for spreading the aqueous solution 5 can be washed with warm water after each use, and organic solvent is not required for tool cleaning. In short, the cleaning method of the invention is very safe for operators and the environment.

The method of the invention can be used for cleaning the finished or unfinished surface of various materials; namely, glass, synthetic resin, metal such as aluminum and others, tile, earthenware, stoneware, porcelain, pottery, wood, concrete, paper, rubber, fiber, stone, soil, lime plaster, paint, and the like. It can be used for cleaning the surface of building materials and sculpture.

In practicing the method of the invention, a suitable plasticizer 3 may be added to the membrane-forming polymer 2. The addition of plasticizer will reduce the viscosity of the aqueous solution 5 and increase the flexibility of the dried membrane 17, so that the efficiency of the operation for spreading, applying, peeling, and recovering may be improved. The plasticizer to be used with the invention must be soluble in water and compatible with the membrane-forming polymer 2. Such plasticizer 3 can be one or more compounds selected from the group consisting of glycerol, ethylene glycol, diethylene glycol, triethylene glycol, propylene glycol, trimethylene glycol, tetramethylene glycol, pentamethylene glycol, hexamethylene glycol, 2,3-butanediol, and 1,3-butanediol, and preferably, it is glycerol and/or propylene glycol. Glycerol and propylene glycol are used as cosmetic materials and they are safe for human and environment.

Table 2 below indicates the result of tests on addition of plasticizer 3 in the aqueous solution 5 in forming the membrane 17 through application of the solution 5 on concrete surface. As can be seen from the comparison of the thickness of the membrane 17 in Tables 1 and 2, the addition of the plasticizer 3 results in a reduction of the thickness of the membrane 17. Although Table 2 relates to the use of the plasticizer 3 at concentration of 1 to 10 Wt. % based on the amount of the polymer 2, the test results indicate that the plasticizer concentration can be suitably selected in a range of 0.5–15 Wt. %.

TABLE 2

| No. | Aqueous solution of polymer* | Plasticizer*** | Membrane produced |
|---|---|---|---|
| 1 | PVA 15% | glycerol 2% | Thickness: 0.08 mm |
| 2 | PVA 15% | glycerol 5% | Thickness: 0.04 mm |
| 3 | PVA 15% | propylene glycol 10% | Thickness: 0.07 mm |

TABLE 2-continued

| No. | Aqueous solution of polymer* | Plasticizer*** | Membrane produced |
|---|---|---|---|
| 4 | PVA 15% | glycerol 1% + propylene glycol 1% | Thickness: 0.08 mm |
| 5 | PVA 15% + EVA** 5% | glycerol 2% | Thickness: 0.08 mm |
| 6 | PVA 30% | glycerol 2% | Thickness: 0.08 mm |

*Wt. % of membrane-forming polymer based on the entire weights of aqueous solution
**Ethylene/vinyl acetate copolymer
***Wt. % of plasticizer based on 100 parts membrane-forming polymer

TABLE 3

| Test item | PVA 15%* | PVA 15%* + glycerol 2%** | PVA 15%* + glycerol 5%** |
|---|---|---|---|
| Width (mm) | 10.0 | 10.0 | 10.0 |
| Thickness (mm) | 0.1 | 0.08 | 0.04 |
| Tensile elasticity ($N/mm^2$) | 3,500 | 126 | 1,350 |
| Tensile strength | | | |
| Load (N) | 97.1 | 24.2 | 24.0 |
| Strength ($N/mm^2$) | 97.1 | 30.2 | 60.1 |
| Breakdown elongation (%), Lo = 100 mm | 2 | 120 | 231 |

*Wt. % of membrane-forming polymer based on the entire weights of aqueous solution
Wt. % of plasticizer based on 100 parts membrane-forming polymer As to the effect of the plasticizer on the toughness of the membrane 17, tests were made on the Specimens No. 1 and No. 2 of Table 2 and the result is shown in Table 3. For comparison, results of tensile test on a membrane 17 formed by aqueous solution of PVA without adding any plasticizer 3 are also shown in Table 3. As can be seen from Table 3, the addition of plasticizer 3 increases the breakdown elongation of the membrane 17 to a great extent as compared with the membrane 17 without plasticizer. In particular, the membrane 17 with the plasticizer 3 added therein can toughly resists the peeling force and elongates to a large extent without rupture, so that such membrane 17 can be easily peeled off from the structural surface 1. In Table 3, the breakdown elongation indicates the elongation (%) of a membrane specimen with an initial length Lo=100 mm when it is subjected to tension until breakdown. It should be noted here that whether to use a plasticizer or not should be determined depending on the conditions of the structural surface 1 to be cleaned, and the addition of the plasticizer does not necessarily facilitate the peeling. With the addition of the plasticizer 3 and the use of the fibrous reinforcing member 15, the peeling and recovery of the membrane 17 can be carried out very efficiently in the operation of cleaning the structural surface 1**.

With the invention, it is also possible to add a filler in the aqueous solution 5. The filler to be use in the method of the invention can be one or more materials selected from the group consisting of silica sand, calcium carbonate, clay, fly ash, blast furnace slag, sand, and the like. Preferably, silica sand and/or calcium carbonate is used for the filler. The filler has effect of reducing the adhesion of the membrane 17 to the structural surface 1, and by adjusting the amount of the filler to be added, the adhesion of the membrane 17 can be regulated to a level for facilitating its peeling. In particular, the addition of calcium carbonate will enable the thickness of the membrane 17 to be at a level suitable for easy peeling. Thus, by the addition of a suitable filler, the efficiency of the work of peeling and recovery of the membrane 17 can be further improved in the operation of cleaning the structural surface 1.

If necessary, it is also possible to add a suitable coloring agent or pigment in the aqueous solution 5 so as to render color to the multi-layer membrane 8.

[Embodiment 1]

An aqueous solution 5 containing 15 Wt. % of polyvinyl alcohol (produced by Kabushikikaisha KURARE with a trade name PVA-120) was applied to a concrete surface and left for 3 hours for producing a substratum membrane 17*a*. The same aqueous solution 5 of PVA was applied again on the substratum membrane 17*a,* and immediately thereafter a gauze for medical use was spread on the fleshly applied layer of the aqueous solution 5 as a fibrous reinforcing member 15, and the same aqueous solution 5 of PVA was applied and left for one day, so as to generate a multi-layer membrane 18 of PVA containing the gauze on the concrete structural surface 1. The thickness of the multi-layer membrane was 0.4 mm. This multi-layer membrane 18 was peeled off from the concrete surface without rupturing more easily as compared with conventional membranes having no gauze added therein.

[Embodiment 2]

The same operation as embodiment 1 was repeated except that 2 Wt. % of glycerol based on the weight of PVA was added in the aqueous solution 5 of PVA as a plasticizer. The same result as that of Embodiment 1 was achieved.

[Embodiment 3]

The same operation as embodiment 1 was repeated except that, instead of the aqueous solution 5 of PVA, an aqueous emulsion 5 containing 56 Wt % of ethylene vinyl acetate copolymer (produced by Kabushikikaisha KURARE with a trade name PANFLEX OM-28) was used. The same result as that of Embodiment 1 was achieved.

[Embodiment 4]

FIGS. 3A–3D and 4A–4B illustrate an example of cleaning dirts on a stucco-finished lime plaster indoor wall relief surface by the method of the invention. If a conventional washing machine with water is used for cleaning a lime plaster finished indoor wall, a number of difficult problems will be caused; namely, that it is difficult to collect water which absorbed dirts, that the lime plaster itself will absorb water and becomes weak, and that there is a risk for the lime plaster to absorb the dirt-carrying water.

Figure 3A:
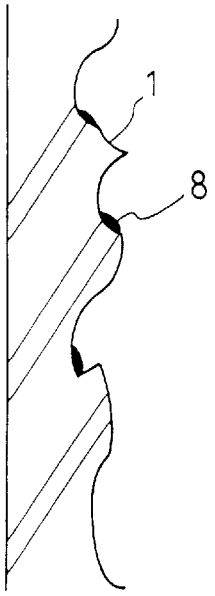
FIGS. 3A–3D show first four steps for cleaning stucco-finished wall relief surface by the method of the invention.
Figure 3B:
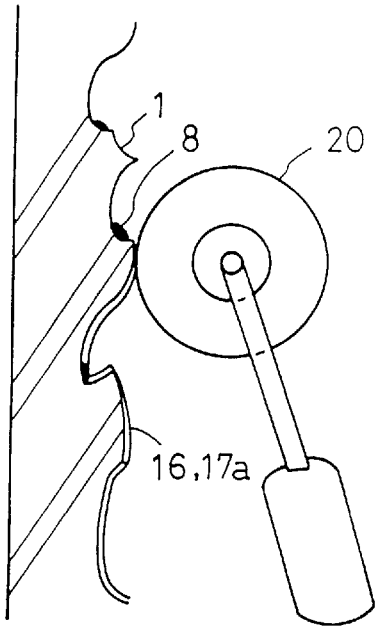
Figure 3C:
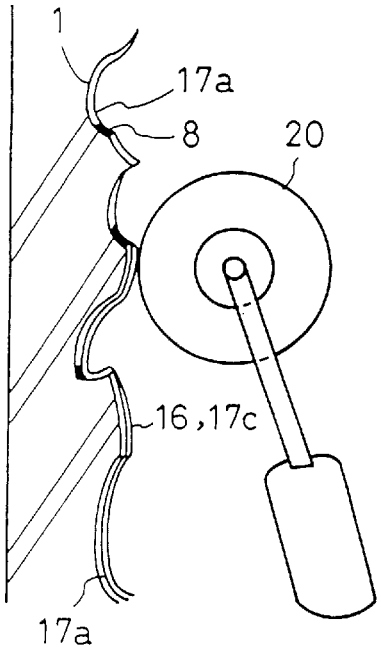
Figure 3D:
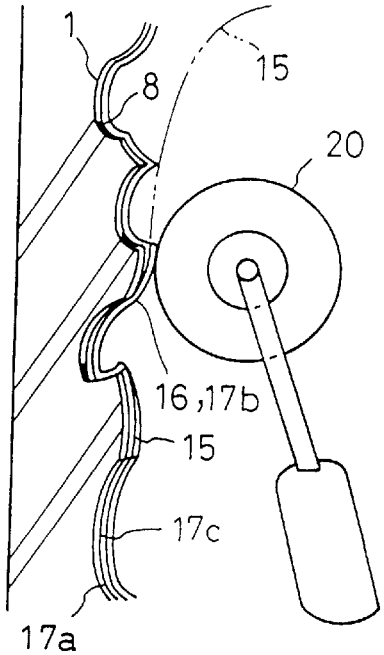
Figure 4A:
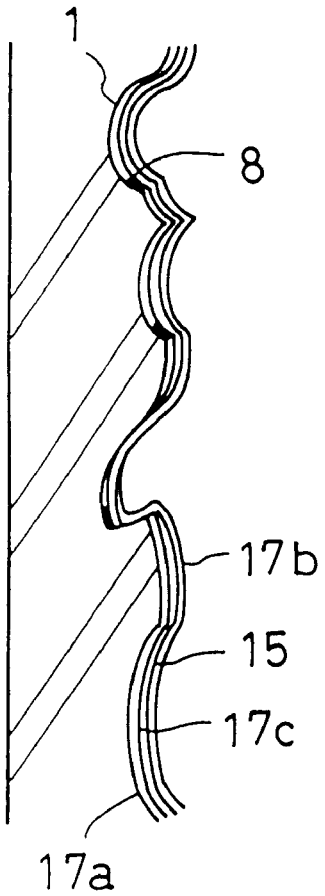
FIGS. 4A and 4B show succeeding steps to that of FIG. 3D.

To the structural surface 1 of FIG. 3A, which is a portion of stucco-finished lime plaster indoor wall relief surface, a thin layer 16 of membrane-forming polymer 2 was applied by a roller 20 and left for one day for drying to produce a substratum membrane 17*a* as depicted in FIG. 3B. Then, another thin layer 16 of the membrane-forming polymer was applied on the substratum membrane 17*a* by the same roller 20 as shown in FIG. 3C, which was a kind of interim layer for making an intermediate membrane 17*c*. A fibrous reinforcing member 15, which was a piece of gauze in this case, was spread on and attached to the interim thin layer 16 while stretching and providing a slack for entering into recessed portions of the stucco-finishing as shown in FIG. 3D. At the same time, a further thin layer 16 of polymer for an overlying membrane 17*b* was applied on the gauze by the same roller 20 while wetting the gauze and paying careful attention not to pull the gauze. After attaching the gauze, the polymer membrane was left for one day for drying, and a multi-layer membrane 18 of four-layered structure having the substratum membrane 17*a,* the intermediate membrane 17*c,* the fibrous reinforcing member 15 and the overlying membrane 17*b* was produced as shown in FIG. 4A.

Figure 4B:
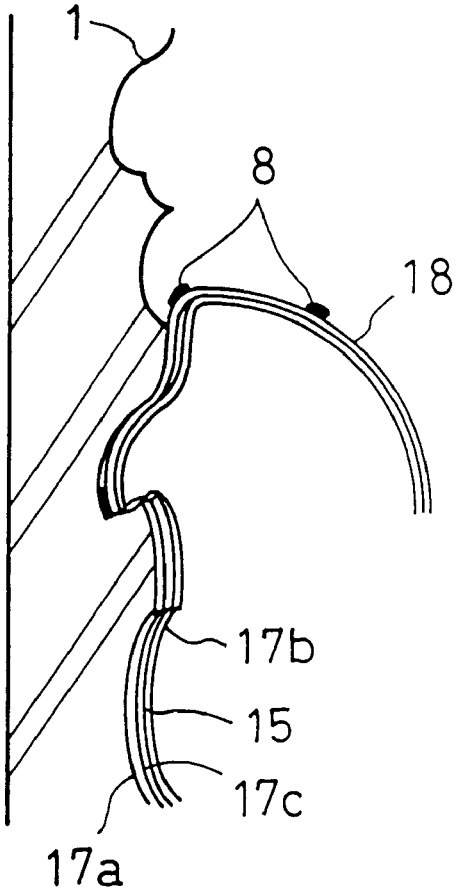
Figure 5A:
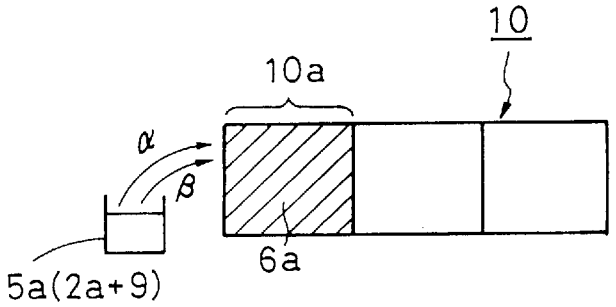
FIGS. 5A–5E are diagrammatic illustrations of a conventional method for cleaning structural surface by using polymer membrane.
Figure 5B:
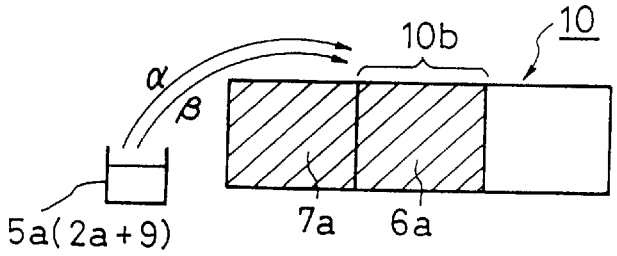
Figure 5C:
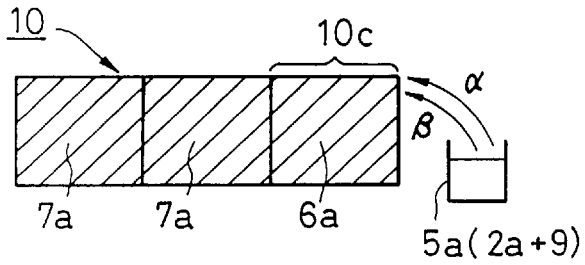
Figure 5D:
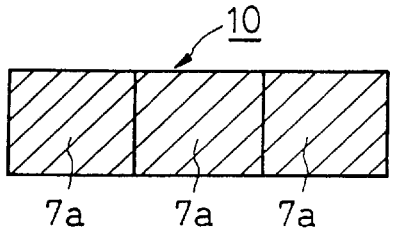
Figure 5E:
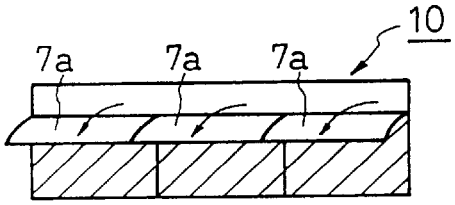
Figure 6:
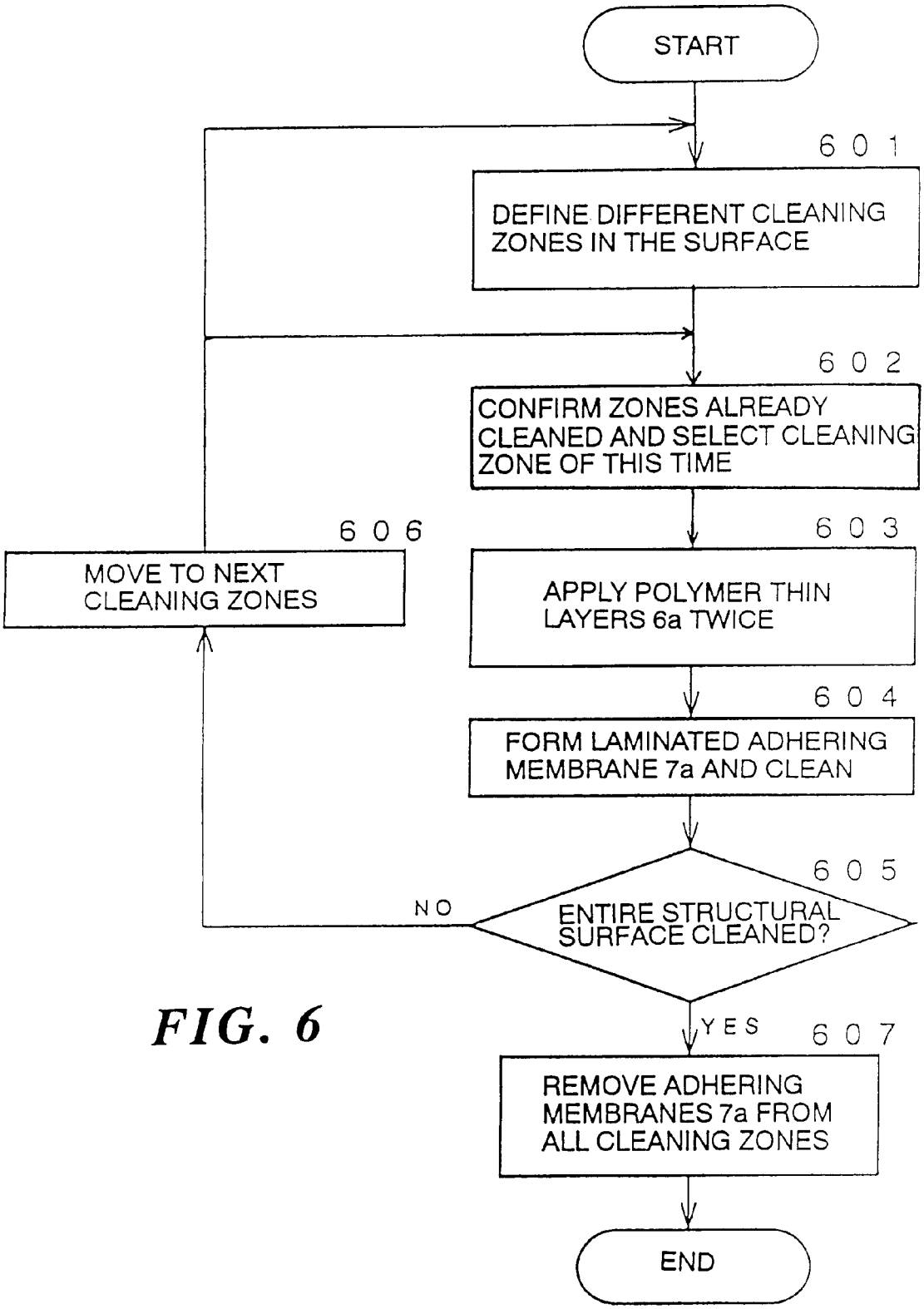
FIG. 6 is a flow chart of the method of FIGS. 5A–5E.

After the drying, the multi-layer membrane 18 was slowly and carefully peeled off while avoiding any harm on the stucco-finished surface, as shown in FIG. 4B. The multi-layer membrane 18 was easily flexed and separated from the surface 1 without any rupture while maintaining its four-layered structure. Of course, foreign matters 8 or dirt substance on the stucco-finished surface 1 were adhered to the substratum membrane 17*a* of the multi-layer membrane 18 and removed together with the multi-layer membrane 18. Thus, the surface of the stucco-finished lime plaster indoor wall was successfully cleaned as intended.

[Embodiment 5]

To check the effect of the degree of polymerization of the PVA on the toughness of PVA membrane, tests were made on three kinds of PVA, i.e., PVA with degrees of polymerization of 550, 1,000 and 2,000. The results are shown in Table 4.

Figure 7A:
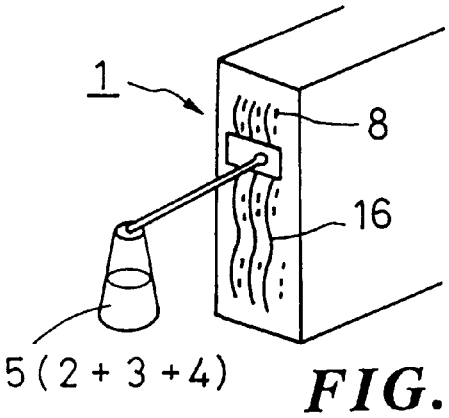
FIGS. 7A–7C show steps in another embodiment of the method for cleaning structural surface according to the invention.
Figure 7B:
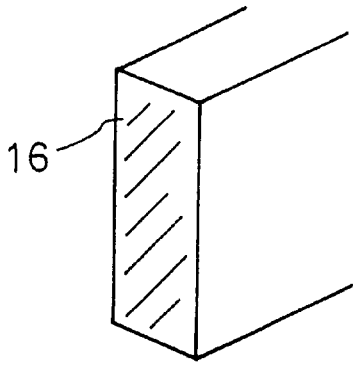

One can see from Table 4 that when PVA with a high degree of polymerization is used, the viscosity of the aqueous solution 5 of PVA becomes high, and the thickness of the thin layer 16 formed by such aqueous solution 5 becomes large, and a peelable membrane can be produced. Referring to FIG. 7, with the knowledge of the data in Table 4, further embodiments of the invention were tested. An aqueous solution of 15 Wt. % PVA was prepared by dissolving 150 g of PVA (produced by Kabushikikaish KURARE with Trade name of PVA-120) having a degree of polymerization of 2,000 and a degree of saponification of 98–99% in 850 g of water. The aqueous solution 5 thus prepared was applied to a structural surface 1, which was a concrete wall in this case, at a rate of about 1,000 g/m$^2$, as shown in FIGS. 7A and 7B.

TABLE 4

| Test item | Reference sample | Specimen 1 | Specimen 2 |
|---|---|---|---|
| Properties of PVA | | | |
| Degree of polymerization | 550 | 1,000 | 2,000 |
| Degree of saponification (%) | 88 | 97–99 | 98–99 |
| Concentration (Wt. %) | 25 | 21 | 15 |
| Viscosity (mPa/s) | 2,120 | 7,860 | 14,000 |
| Film properties (Maker's data, 20° C., 66% (moist)) | | | |
| Peeling strength (g/cm) | 28 | 14.8 | 10.5 |
| Yield strength (kg/mm$^2$) | 1.95 | 2.20 | 2.76 |
| Rupture strength (kg/mm$^2$) | 2.89 | 3.70 | 6.21 |
| Elongation (%) | 157 | 285 | 312 |
| Structural surface of glass | | | |
| Amount applied (g/m$^2$) | 400 | 1,000 | 1,000 |
| Thickness of thin layer (mm) | 0.293 | 0.960 | 0.975 |
| Drying time (h) | 12 | 12 | 12 |
| Water content (after 12 h) | 0.83 | 1.5 | 1.76 |
| Moisture meter reading* | 0 | 3.0 | 3.6 |
| Peeling | possible | possible | possible |
| Peeling strength (g/10 cm) | ruptured | 200 | 250 |
| Thickness of dry membrane (mm) | 0.05 | 0.19 | 0.24 |
| Structural surface of concrete | | | |
| Amount applied (g/m$^2$) | 400 | 1,200 | 1,500 |
| Thickness of thin layer (mm) | 0.085 | 0.70 | 0.79 |
| Drying time (h) | 12 | 12 | 12 |
| Water content (after 12 h) | 0 | 4.75 | 13.41 |
| Moisture meter reading* | 0 | 10.0 | 12.9 |
| Peeling | impossible | possible | possible |
| Thickness of dry membrane (mm) | — | 0.4 | 0.5 |

*STORCH COMPANY TYPE HPM 2000

Figure 7C:
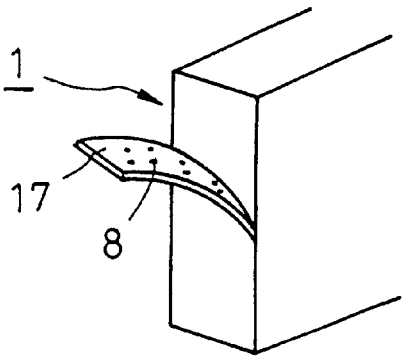

After being dried into a membrane 17 by leaving for 12 hours, it was peeled off successfully, as shown in FIG. 7C.

Foreign matters 8 or dirt substances on the structural surface 1 were removed together with the membrane 17.

[Embodiment 6]

An aqueous solution of 15 Wt. % PVA was prepared by dissolving 150 g of PVA (produced by Kabushikikaish KURARE with Trade name of PVA-120) having a degree of polymerization of 2,000 and a degree of saponification of 98–99% in 850 g of water. The aqueous solution 5 thus prepared was applied to a rough concrete structural surface 1 with projections and recesses, at a rate of about 1,500 g/m$^2$.

After being dried into a membrane 17 by leaving for 12 hours, it was peeled off successfully. Foreign matters 8 or dirt substances on the structural surface 1 were removed together with the membrane 17.

It has been found through further tests that PVA with a degree of polymerization of 1,000 to 3,000 can be used for producing a peelable tough membrane 17 on structural surface 1 by spreading an aqueous solution thereof at a concentration of 10 to 30% by weight. If the degree of polymerization of PVA is smaller than 1,000, desired toughness of the membrane 17 cannot be achieved, and if the degree of polymerization of PVA exceeds 3,000 the viscosity of the aqueous solution becomes too high for uniform spreading.

[Embodiment 7]

An aqueous solution of 15 Wt. % PVA was prepared by dissolving 150 g of PVA (produced by Kabushikikaish KURARE with Trade name of PVA-117) having a degree of polymerization of 1,700 and a degree of saponification of 98–99% in 850 g of water. The aqueous solution 5 thus prepared was applied to a concrete structural surface 1, at a rate of about 950 g/m$^2$.

Similar cleaning effect as that of the above Embodiment 5 was proved with this embodiment, too

[Embodiment 8]

An aqueous solution of 17 Wt. % PVA was prepared by dissolving 170 g of PVA (produced by Kabushikikaish KURARE with Trade name of PVA-117) having a degree of polymerization of 1,700 and a degree of saponification of 98–99% in 850 g of water. The aqueous solution 5 thus prepared was applied to a concrete structural surface 1, at a rate of about 1,000 g/m$^2$.

Similar cleaning effect as that of the above Embodiment 5 was proved with this embodiment, too.

[Embodiment 9]

An aqueous solution of 15 Wt. % PVA was prepared by dissolving 150 g of PVA (produced by Kabushikikaish KURARE with Trade name of PVA-117) having a degree of polymerization of 1,700 and a degree of saponification of 97–99% in 850 g of water. The aqueous solution 5 thus prepared was applied to a concrete structural surface 1, at a rate of about 1,000 g/m$^2$.

Similar cleaning effect as that of the above Embodiment 5 was proved with this embodiment, too.

[Embodiment 10]

An aqueous solution of 15 Wt. % PVA was prepared by dissolving 150 g of PVA (produced by Kabushikikaish KURARE with Trade name of PVA-120) having a degree of polymerization of 2,000 and a degree of saponification of 98–99% in 750 g of water and 100 g of ethyl alcohol. The aqueous solution 5 thus prepared was applied to a concrete structural surface 1, at a rate of about 1,000 g/m$^2$.

After being dried into a membrane 17 by leaving for 10 hours, it was peeled off successfully. Foreign matters 8 or dirt substances on the structural surface 1 were removed together with the membrane 17.

[Embodiment 11]

An aqueous emulsion of ethylene/vinyl acetate copolymer (EVAC) (produced by Kabushikikaish KURARE with Trade name of OM-28) was applied to a concrete structural surface 1, at a rate of about 850 g/m$^2$.

After being dried into a membrane 17 by leaving for 12 hours, it was peeled off successfully. Foreign matters 8 or dirt substances on the structural surface 1 were removed together with the membrane 17.

[Embodiment 12]

An aqueous emulsion of ethylene/vinyl acetate copolymer (EVAC) (produced by Kabushikikaish KURARE with Trade name of OM-4200) was applied to a concrete structural surface 1, at a rate of about 700 g/m$^2$.

Similar cleaning effect as that of the above Embodiment 11 was proved with this embodiment, too.

[Embodiment 13]

An aqueous emulsion of ethylene/vinyl acetate copolymer (EVAC) (produced by Kabushikikaish KURARE with Trade name of OM-5500) was applied to a concrete structural surface 1, at a rate of about 720 g/m$^2$.

Similar cleaning effect as that of the above Embodiment 11 was proved with this embodiment, too.

[Embodiment 14]

An aqueous emulsion of ethylene/vinyl acetate copolymer (EVAC) (produced by Kabushikikaish KURARE with Trade name of OM-600) was applied to a concrete structural surface 1, at a rate of about 700 g/m$^2$.

Similar cleaning effect as that of the above Embodiment 11 was proved with this embodiment, too.

In producing the membrane to be used in the method of the invention, it is possible to add sterilizing function to the membrane by adding a suitable agent in it, such as a pesticide, germicide, aromatic, a bleaching agent, a surfactant, and the like. For instance, when a structural surface is contaminated with micro-organism such as fungus, bacteria, or algae, one can remove the contaminating micro-organism by using an aqueous solution of the invention which contains a suitable anti-micro-organism agent such as pesticide, germicide, aromatic, and the like in producing the membrane. At the time of removing the membrane, the micro-organism living on the structural surface is adhered to the membrane together with other foreign matters and removed from the structural surface. Thus, a high-degree of cleaning can be accomplished. The anti-micro-organism may exude from the membrane and remain on the structural surface, so that even after the peeling of the membrane, the structural surface can be protected against recontamination by unwanted micro-organism.

Industrial Applicability

As described in detail in the foregoing, with the method of cleaning structural surface according to the invention, the following outstanding effects can be achieved by the use of the water soluble polymer, possibly together with the fibrous reinforcing member.

(1) A method for cleaning structural surface by forming a peelable polymer membrane thereon is provided. Even if the membrane of the water soluble polymer is so dried as to become brittle, it can be removed together with the fibrous reinforcing member, so that operation of peeling and recovering the membrane can be made easier.

(2) With the use of easily applicable aqueous solution having a comparatively low viscosity, an easily removable multi-layer membrane can be formed, so that high efficiency can be achieved in both applying the solution and peeling the membrane.

(3) The membrane removed from the structural surface may be recycled by dissolving it in warm water. Even if disposed by burning, noxious gas is never generated.

(4) The aqueous solution can be easily handled, and it has a high degree of safety to human and environment.

(5) Rough surface with projections and recesses can be cleaned with a high reliability.

What is claimed is:

1. A method for cleaning a structural surface by forming a peelable polymer membrane thereon, comprising steps of applying a thin layer of an aqueous solution or emulsion of a membrane-forming polymer on a structural surface;

drying the thin layer to produce a substratum membrane on the structural surface, spreading a fibrous reinforcing member on either the thin layer before said drying or the substratum membrane after said drying;

applying the aqueous solution or emulsion on the outer surface of the fibrous reinforcing member while wetting the reinforcing member;

drying the aqueous solution or emulsion on the reinforcing member to produce an overlying membrane integral with both the substratum membrane and the reinforcing member to produce a multi-layer membrane in which the substratum and overlying membranes sandwich the reinforcing member; and peeling off said multi layer membrane from the structural surface after adhesion of foreign matters on the structural surface to the substratum membrane.

2. The method of claim 1, further comprising:

applying another thin layer of the aqueous solution or emulsion on either said thin layer before said drying or the substratum membrane after said drying; and drying said another thin layer to produce an intermediate membrane, wherein said fibrous reinforcing member is spread on said another thin layer to produce the intermediate membrane, and said aqueous solution or emulsion is applied on the outer surface of the reinforcing member while wetting the reinforcing member and is dried to produce an overlying membrane integral with both the intermediate membrane and the reinforcing member to produce a multi-layer membrane in which the substratum and overlying membranes sandwiching both the intermediate membrane and the reinforcing member, whereby after adhesion of foreign matters on the structural surface to the substratum membrane, the multi-layer membrane is peeled off from the structural surface.

3. The method of claim 1, wherein the fibrous reinforcing member is a sheet member to which the aqueous solution or emulsion is permeable.

4. The method of claim 1, wherein the membrane-forming polymer in the aqueous solution or emulsion is a material or a mixture of materials selected from the group consisting of polyvinyl alcohol polymer, carboxymethyl cellulose polymer, polyvinyl chloride polymer, acrylic resin polymer, polyvinyl butyral polymer, and ethylene/vinyl acetate copolymer.

5. The method of claim 4, wherein the membrane-forming polymer in the aqueous solution or emulsion is a polyvinyl alcohol polymer and/or ethylene/vinyl acetate copolymer, and the aqueous solution or emulsion contains 5–30% by weight of polyvinyl alcohol polymer and/or 40–80% by weight of ethylene/vinyl acetate copolymer.

6. The method of claim 1, wherein the fibrous reinforcing member is gauze, non-woven fabric, plastic net and/or glass fiber mat.

7. The method of claim 1, wherein a plasticizer is added in the aqueous solution or emulsion of the membrane-forming polymer.

8. The method of claim 7, wherein the plasticizer is glycerol and/or propylene glycerol.

9. The method of claim 1, wherein a filler is added in the aqueous solution or emulsion of the membrane-forming polymer.

10. The method of claim 9, wherein the filler is a material or a mixture of materials selected from the group consisting of silica sand, calcium carbonate, clay, fly ash, blast furnace slag powder, and sand.

11. A method for cleaning a structural surface by forming a peelable polymer membrane thereon, comprising:

applying a thin layer of aqueous solution or emulsion of a membrane-forming polymer on a structural surface;

drying the thin layer so as to produce a substratum membrane on the structural surface;

applying a mixed solution comprising the aqueous solution or emulsion and short fibers added therein on either said thin layer before said drying or said substratum membrane after said drying;

drying the applied mixed solution to produce an overlying membrane integral with the substratum membrane to produce a multi-layer membrane having the substratum and overlying membranes; and peeling off said multi-layer membrane from the structural surface after adhesion of foreign matters on the structural surface to the substratum membrane.

12. The method of claim 11, further comprising spreading a fibrous reinforcing member on said thin layer before drying or on said substratum membrane after drying, wherein the aqueous solution or emulsion of membrane-forming polymer or a mixed solution made of the aqueous solution or emulsion and short fibers added therein is applied on the outer surface of said reinforcing member while wetting the reinforcing member and is dried for producing an overlying membrane integral with both the substratum membrane and the reinforcing member so as to generate a multi-layer membrane having the substratum and overlying membranes sandwiching the reinforcing member, whereby after adhesion of foreign matters on the structural surface to the substratum membrane, the multi-layer membrane is peeled off from the structural surface.

13. The method of claim 11, wherein the aqueous solution or emulsion of membrane-forming polymer or a mixed solution made of the aqueous solution or emulsion and short fibers added therein is applied on either said thin layer before drying or said substratum membrane and is dried to produce an intermediate membrane upon drying; a fibrous reinforcing member is spread on said the intermediate membrane and said aqueous solution or emulsion or said mixed solution is applied on the outer surface of said reinforcing member while wetting the reinforcing member and is dried for producing an overlying membrane integral with both the intermediate membrane and the reinforcing member so as to generate a multi-layer membrane having the substratum membrane with the intermediate membrane integral therewith and the overlying membrane sandwiching the reinforcing member, whereby after adhesion of foreign matters on the structural surface to the substratum membrane, the multilayer membrane is peeled off from the structural surface.

14. The method of claim 11, wherein the short fiber is a material or a mixture of materials selected from the group consisting of wood pulp, cotton, acrylic fiber, polyester, silk, hemp yarn, plastics, and glass fiber.

15. A method for cleaning a structural surface by forming a peelable polymer membrane thereon, comprising:

applying a thin layer of a mixed solution comprising an aqueous solution or emulsion of a membrane-forming polymer and short fibers added therein on a structural surface;

drying the thin layer to produce a substratum membrane therefrom;

applying the mixed solution on either said thin layer before drying or said substratum membrane after said drying;

drying said applied mixed solution to produce an overlying membrane integral with the substratum membrane to produce a multi-layer membrane having the substratum and overlying membranes; and peeling off said multi-layer membrane from the structural surface after adhesion of foreign matters on the structural surface to the substratum membrane.

16. A method for cleaning a structural surface by forming a peelable polymer membrane thereon, comprising:

applying a thin layer of a mixed solution comprising an aqueous solution or emulsion of a membrane-forming polymer and short fibers added therein on a structural surface;

drying said thin layer to produce a substratum membrane with the short fibers therein, applying the aqueous solution or emulsion on either said thin layer before said drying or said substratum membrane after said drying;

drying the applied solution or emulsion to produce an overlying membrane integral with the substratum membrane to produce a multi-layer membrane having the substratum and overlying membranes; and peeling off said multi-layer membrane from the structural surface after adhesion of foreign matters on the structural surface to the substratum membrane.

17. A method for cleaning a structural surface by forming a peelable polymer membrane thereon, comprising:

applying two or more thin layers of either an aqueous solution or emulsion of a membrane-forming polymer with or without short fibers added therein on a structural surface;

drying said thin layers to produce a substratum membrane with or without short fibers therein;

applying at least one other thin layer of said aqueous solution or emulsion with or without short fibers added therein on the outermost thin layer before drying or on outer surface of the substratum membrane;

drying said other thin layer for producing one or more overlying membranes integral with the substratum membrane to produce a multi-layer membrane having the substratum and overlying membranes; and peeling off said multi-layer membrane from the structural surface after adhesion of foreign matters on the structural surface to the substratum membrane.

18. The method of claim 17, further comprising:

spreading a fibrous reinforcing member on the outermost thin layer before drying or on the outermost substratum membrane after drying, and the aqueous solution or emulsion with or without short fibers added therein is applied at least once on said reinforcing member, and is dried for producing one or more overlying membranes integral with both the substratum membrane and the reinforcing member so as to generate a multi-layer membrane having the substratum and overlying membranes sandwiching the reinforcing member, whereby after adhesion of foreign matters on the structural surface to the substratum membrane, the multi-layer membrane is peeled off from the structural surface.

19. The method of claim 17, wherein the aqueous solution or emulsion is applied one or more times on either said outermost thin layer before drying or said substratum membrane after dried so as to form one or more thin layers and is dried for making one or more intermediate membranes, a fibrous reinforcing member is spread on the outermost intermediate membrane, and the aqueous solution or emulsion with or without short fibers added therein is applied at least once on said reinforcing member and is dried for producing one or more overlying membranes integral with both the intermediate membrane and the reinforcing member so as to generate a multi-layer membrane having the substratum with intermediate membranes and overlying membranes sandwiching the reinforcing member, whereby after adhesion of foreign matters on the structural surface to the substratum membrane, the multilayer membrane is peeled off from the structural surface.

20. A method for cleaning a structural surface by forming a peelable polymer membrane thereon, comprising:

applying a thin layer of aqueous solution or emulsion containing 10–30% by weight of polyvinyl alcohol having a degree of polymerization of 1,000 to 3,000 and a degree of saponification of 95 to 99 mole % on a structural surface, the aqueous solution or emulsion having a viscosity of 5,000 to 100,000 mPa.s;

drying the thin layer to produce an easily peelable and easily recoverable adhering membrane; and peeling off said membrane from the structural surface after adhesion of foreign matters on the structural surface to the membrane.

21. The method of claim 20, further comprising:

applying an other thin layer of said aqueous solution or emulsion on the outer surface of either said thin layer before drying or said membrane forming a substratum membrane, and drying said other thin layer for producing an overlying membrane integral with the substratum membrane so as to generate a multi-layer membrane having the substratum and overlying membranes, whereby after adhesion of foreign matters on the structural surface to the substratum membrane, said multi-layer membrane is peeled off from the structural surface.

22. A method for cleaning a structural surface by forming a peelable copolymer membrane thereon, comprising:

applying a thin layer of aqueous solution or emulsion containing 40–80% by weight of ethylene/vinyl acetate copolymer having a vinyl acetate content of 98 to 50 mole % on a structural surface;

drying the thin layer to produce an easily peelable and easily recoverable adhering membrane; and peeling off said membrane from the structural surface after adhesion of foreign matters on the structural surface to the membrane.

* * * * *